United States Patent [19]

Kaufmann

[11] 4,293,211

[45] Oct. 6, 1981

[54] AUTOMATIC REPLENISHER CONTROL SYSTEM

[75] Inventor: Kenneth M. Kaufmann, Minneapolis, Minn.

[73] Assignee: Pako Corporation, Minneapolis, Minn.

[21] Appl. No.: 168,019

[22] Filed: Jul. 14, 1980

[51] Int. Cl.[3] ..... G03D 13/00; G03D 3/06

[52] U.S. Cl. ..... 354/298; 354/321; 354/324; 137/624.15; 222/76

[58] Field of Search ..... 354/321, 322, 323, 324, 354/298; 134/94; 250/578, 559; 137/93, 624.15; 355/10, 27; 356/443, 444; 222/70, 76

[56] References Cited

U.S. PATENT DOCUMENTS

| | | | |
|---|---|---|---|
| 3,472,143 | 10/1969 | Hixon et al. | 95/89 |
| 3,529,529 | 9/1970 | Schumacher | 95/89 |
| 3,554,109 | 1/1971 | Street et al. | 354/298 |
| 3,559,555 | 2/1971 | Street | 95/89 |
| 3,561,344 | 2/1971 | Frutiger et al. | 95/89 |
| 3,623,418 | 11/1971 | Ost | 354/298 |
| 3,636,851 | 1/1972 | Furst | 95/89 R |
| 3,696,728 | 10/1972 | Hope | 95/89 |
| 3,752,052 | 8/1973 | Hope et al. | 95/89 R |
| 3,787,689 | 1/1974 | Fidelman | 250/219 FR |
| 3,822,723 | 7/1974 | Crowell et al. | 222/70 |
| 3,927,417 | 12/1975 | Kinoshita et al. | 354/298 |
| 3,990,088 | 11/1976 | Takita | 354/298 |
| 3,995,959 | 12/1976 | Shaber | 354/298 |
| 4,057,818 | 11/1977 | Gaskell et al. | 354/298 |
| 4,104,670 | 8/1978 | Charnley et al. | 354/324 |
| 4,119,952 | 10/1978 | Takahashi et al. | 340/309.1 |
| 4,128,325 | 12/1978 | Melander et al. | 354/298 |
| 4,134,663 | 1/1979 | Laar et al. | 354/298 |
| 4,174,169 | 11/1979 | Melander et al. | 354/324 |

*Primary Examiner*—L. T. Hix

*Assistant Examiner*—Stafford D. Schreyer

*Attorney, Agent, or Firm*—Kinney, Lange, Braddock, Westman and Fairbairn

[57] ABSTRACT

An automatic fluid replenisher control system for processors of photosensitive material stores density aim point values for control strips of photosensitive material, a developer exhaustion replenishment rate, and anti-oxidation replenishment rate. Signals are provided from which the area and the density of the material processed can be determined. The automatic replenisher control system provides exhaustion replenishment as a function of area and density of the processed material and the stored developer exhaustion replenishment rate, and provides anti-oxidation replenishment as a function of the anti-oxidation replenishment rate and the amount of exhaustion replenishment which has been provided. On a periodic basis, a control strip is processed, and densities of a high and a low density area of the control strip are measured. The automatic replenisher control system compares the low density value with one of the density aim point values. Based upon this comparison, the automatic replenishment control system leaves the exhaustion replenishment rate unchanged, adds additional exhaustion replenishment, inhibits exhaustion replenishment for a predetermined time interval, requests an additional control strip after a predetermined time interval, and/or adjusts the stored exhaustion replenishment rate. Once the measured density from the low density area of the control strip is within a selected range of the density aim point value, the automatic replenishment control system compares the difference between the two measured densities of the control strip with the difference between the two density aim point values. Anti-oxidation replenishment is adjusted in a similar manner.

26 Claims, 2 Drawing Figures

AUTOMATIC REPLENISHER CONTROL SYSTEM

BACKGROUND OF THE INVENTION

1. Field of the Invention.

The present invention relates to a replenisher control system for use in processors of photosensitive material.

2. Description of the Prior Art

Automatic photographic film and paper processors transport sheets or webs of photographic film or paper through a sequence of processor tanks in which the photosensitive material is developed, fixed, and washed, and then transports the material through a dryer. It is well known that photographic processors require replenishment of the processing fluids to compensate for changes in the chemical activity of the fluids.

First, it has been recognized that replenishment is necessary to replace constituents used as photosensitive film or paper is developed in the processor. This replenishment is "use related" or "exhaustion" chemical replenishment. Both developer and fix solutions require exhaustion replenishment.

Second, chemical activity of the developer solution due to aerial oxidation occurs with the passage of time regardless of whether film or paper is being processed. Some replenishment of an "anti-oxidation" (A-O) replenishment solution which counteracts this deterioration.

Replenishment systems were originally manually operated. The operator would visually inspect the processed film or paper and manually operate a replenisher system as he deemed necessary. The accuracy of the manual replenisher systems was obviously dependent upon the skill and experience of the operator.

Various automatic replenishment systems have been developed for providing use-related replenishment. Examples of these automatic replenishment systems include U.S. Pat. Nos. 3,472,143 by Hixon et al; 3,529,529 by Schumacher; 3,554,109 by Street et al; 3,559,555 by Street; 3,561,344 by Frutiger et al; 3,696,728 by Hope; 3,752,052 by Hope et al; 3,787,689 by Fidelman; 3,927,417 by Kinoshita et al; 3,990,088 by Takita; 4,057,818 by Gaskell et al; 4,104,670 by Charnley et al; 4,119,952 by Takahashi et al; 4,128,325 by Melander et al; and 4,134,663 by Laar et al. Examples of prior art replenisher controls for providing both exhaustion and anti-oxidation replenishment are shown in U.S. Pat. Nos. 3,822,723 by Crowell et al and 4,174,169 by Melander et al.

In the past, test strips or control strips of photosensitive material have been processed and then evaluated for determining whether the processor is yielding processed material having the desired densities. Patents showing automatic evaluation of test strips include U.S. Pat. Nos. 3,623,418 by Ost; 3,636,851 by Fürst; and 3,995,959 by Shaber.

The Ost Patent 3,623,418 describes a system in which a test strip of photographic film is transported through a developer sample chamber, where it is developed using a sample of developer fluid from the main developer tank. The developed test strip then passes between a lamp and a densitometer head, which senses the intensity of light transmitted through the test strip. The resistance of the densitometer is connected in a bridge circuit which is used to control replenishment.

The Fürst U.S. Pat. No. 3,636,851 shows a film processor which includes a sensitometer for recording test information on a test prior to the test film entering the processor tanks, and a densitometer at the output end of the processor for measuring density of the processed test film. The Fürst patent suggests the possibility of supplying the densiometric data in digital form to a process controller to control the entire manufacturing operation.

The Shaber U.S. Pat. No. 3,995,959 shows a processor in which a test strip includes areas of unexposed (base fog) area, light (medium density) area, and dark (high density) area. Densitometer readings are made of the processed test film and signals are generated indicating whether the base fog area is acceptable or too dark; whether the dark area is acceptable or too light; and whether the medium area is acceptable, too light, or too dark. Based upon these signals, light emitting diodes are lit to indicate the status of the film processor. The light emitting diodes indicate the following conditions: acceptable, developer underreplenished, developer temperature too low, developer overreplenished, developer temperature too high, and developer contaminated.

SUMMARY OF THE INVENTION

The automatic replenisher control system of the present invention makes supplemental adjustments to developer and anti-oxidation replenishment in a photographic processor as a function of measured density values from control strips which are periodically processed by the photographic processor. The control system includes means for storing density aim point values which indicate desired sensitivity and screen range values of the control strips.

If the measured sensitivity of a control strip is outside a desired sensitivity range, the control system makes a small bulk addition of exhaustion developer replenishment or inhibits developer exhaustion replenishment for a predetermined time interval, depending on whether the measured sensitivity is below or above the desired range. The control system requests another control strip at the end of a predetermined interval, and compares measured sensitivity to the desired sensitivity range for the new control strip. If the measured sensitivity continues to deviate from the desired sensitivity range, the control system adjusts the developer exhaustion replenishment rate and requests another control strip at the end of a predetermined interval. This process of bulk adjustments and replenishment rate adjustments continues until the measured sensitivity falls within the desired sensitivity range.

Similar bulk adjustments and adjustments of anti-oxidation replenishment rate are performed based upon the measured screen range from the control strips. The control system first attempts to bring the measured screen range value into the desired range by bulk adjustment, and requests another control strip after a predetermined interval. If the measured contrast continues to deviate from the desired range, adjustment of the anti-oxidation replenishment rate is made. The process continues until the measured screen range of a control strip falls within the desired contrast range.

The automatic replenisher control system of the present invention, therefore, distinguishes between long term deviations in developer chemistry and short term deviations in developer chemistry (which can occur due to the processing of only one or just a few sheets of material having a substantially different density image from normal). Bulk adjustments provided by a bulk addition of replenisher or inhibiting replenishment for a predetermined time interval often will correct a short term deviation in developer chemistry, without the need for disturbing the developer exhaustion replenishment rate or the anti-oxidation replenishment rate. If, however, long term deviations occur, these indicate that the exhaustion replenishment rates are no longer correct, and the control system of the present invention makes adjustments to the replenishment rates until the developer chemistry again yields the desired sensitivity and screen range in the control strips.

DETAILED DESCRIPTION OF PREFERRED EMBODIMENTS

Figure 1:
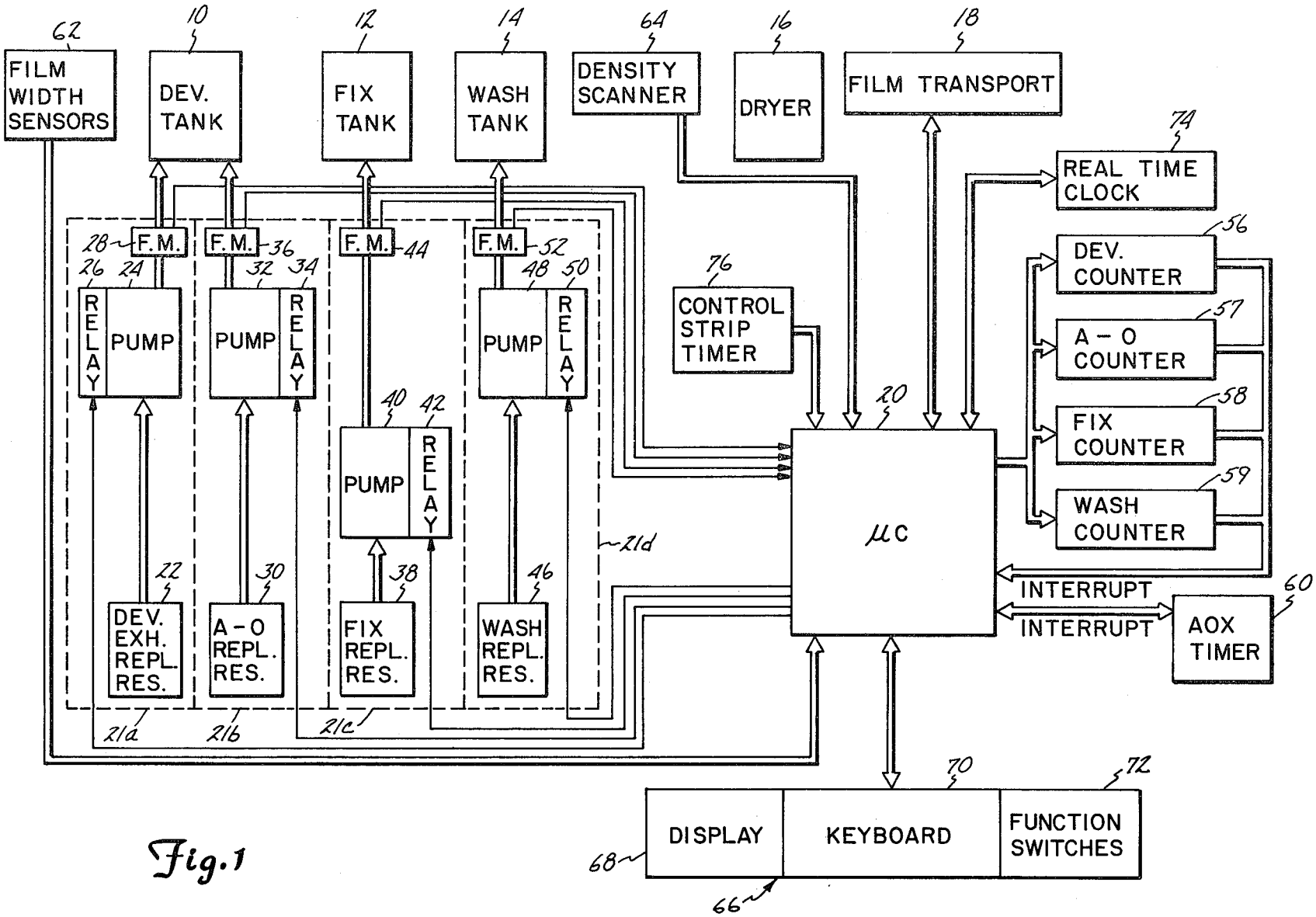
FIG. 1 is a block diagram illustrating a preferred embodiment of the automatic replenishment control system of the present invention.

As shown in FIG. 1, the automatic replenishment control system of the present invention controls replenishment of processor fluids in a photographic processor. In the system shown in FIG. 1, the processor includes developer tank 10, fix tank 12, wash tank 14, and dryer 16. Film transport drive 18 transports the strip or web of photosensitive material (either film or paper) through tanks 10, 12, 14 and dryer 16. Microcomputer 20 controls operation of film transport 18 and of the automatic replenishment of fluids to tanks 10, 12 and 14.

The auto-replenishment system shown in FIG. 1 includes developer replenisher 21*a* and anti-oxidation replenisher 21*b* for providing exhaustion and anti-oxidation replenishment, respectively, to developer tank 10. In addition, the system includes fix replenisher 21*c* for providing fix replenishment to fix tank 12, and wash replenisher 21*d* for providing wash replenishment to wash tank 14.

Developer replenisher 21*a* includes exhaustion replenishment reservoir 22, pump 24, pump relay 26, and flow meter or switch 28. Exhaustion replenishment for developer tank 10 is supplied from exhaustion replenishment reservoir 22 by means of pump 24. Microcomputer 20 controls operation of pump 24 through pump relay 26. Flow meter or switch 28 monitors the exhaustion replenishment fluid actually pumped by pump 24 to developer tank 10, and provides a feedback signal to microcomputer 20.

Anti-oxidation replenisher 21*b* includes A-O replenisher reservoir 30, pump 32, pump relay 34, and flow meter or switch 36. Anti-oxidation replenishment is supplied from A-O replenisher reservoir 30 to developer tank 10 by pump 32. Microcomputer 20 controls operation of pump 32 by means of relay 34. Flow meter or switch 36 monitors flow of A-O replenishment to developer tank 10 and provides a feedback signal to microcomputer 20.

Fix replenisher 21*c* includes fix replenisher reservoir 38, pump 40, pump relay 42, and flow meter or switch 44. Fix replenishment is supplied to fix tank 12 from fix replenisher reservoir 38 by pump 40, which is controlled by microcomputer 20 through relay 42. Flow meter of switch 44 monitors flow of replenishment fluid to fix tank 12, and supplies a feedback signal to microcomputer 20.

Wash replenisher 21*d*, which includes wash reservoir 46, pump 48, pump relay 50, and flow meter or switch 52, provides replenishment of wash fluid (typically water) in wash tank 14. The wash fluid is supplied from wash replenishment reservoir 46, and is pumped to wash tank 14 by pump 48. Microcomputer 20 controls pump 48 through relay 50, and monitors the flow of wash replenishment to tank 14 by means of flow meter or switch 52.

Microcomputer 20 utilizes developer counter 56, A-O counter 57, fix counter 58, and wash counter 59 as timers to control replenishment. When, for example, exhaustion replenishment is required, microcomputer 20 loads a numerical value (DEVTIME) into developer counter 56, which then begins counting. Microcomputer 20 energizes relay 26, which actuates pump 24. When developer counter 56 reaches a predetermined value (such as zero), it provides an interrupt signal to microcomputer 20, which de-energizes relay 26. The numerical value (DEVTIME), therefore, determines the total amount of exhaustion developer replenisher pumped into tank 10.

Counters 57, 58 and 59 are operated in a similar manner. The numerical values loaded into counters 57, 58 and 59 are hereafter referred to as AOXTIME, FIXTIME and WASHTIME, respectively.

AOX time 60 is a free running timer which provides an interrupt signal to microcomputer 20 on a periodic basis to initiate A-O replenishment. In one preferred embodiment, AOX timer 60 provides the interrupt signal every 22.5 minutes.

Microcomputer 20 also receives signals from film width sensors 62 and density scanner 64. Film width sensors 62 are positioned at the input throat of the processor, and provide signals indicating the width of the strip of photosensitive material as it is fed into the processor. Since microcomputer 20 also controls film transport 18, and receives feedback signals from film transport 18, the width signals from film width sensors 62 and the feedback signals from film transport 18 provide an indication of the area of photosensitive material being processed.

Density scanner 64 senses density of the processed photosenstive material. The signals from density scanner 64 provide an indication of the integrated density of the processed photosensitive material. The integrated density, together with the area of material processed, provides an indication of the amount of processor fluids used in processing that material.

Microcomputer 20 also receives signals from control panel 66, which includes function switches 68, keyboard 70, and display 72. Function switches 68 select certain functions and operating modes of the processor. Keyboard 70 permits the operator to enter numerical information, and other control signals used by microcomputer 20 in controlling operation of the processor, including replenishment. Display 72 displays messages or numerical values in response to control signals from microcomputer 20.

In the preferred embodiments of the invention, the replenishment control system is usable in a processor capable of processing both film and paper. In one embodiment, in which density scanner 64 operated on a basis of light transmission through the photosensitive material, density scanner 64 is unable to determine the densities of images on photographic paper. Therefore, the approximate density of images on the paper are provided by function switches 72. For example, function switches 72 permit the operator to select an approximate density of twenty-five percent, fifty percent, or seventy-five percent for the images on the paper. When one of these switches is selected, microcomputer 20 controls replenishment on the basis of these approximate density values, rather than signals from density scanner 64.

Also shown in FIG. 1 is real time clock 74, which maintains the time of day. Real time clock 74 preferably is provided with battery backup power 50 so that it continues to operate even when power to the processor is turned off.

In a preferred embodiment of the present invention, microcomputer 20 stores set values for each of a plurality of photosensitive materials that may be processed in the processor. Each group of set values includes pump rates for pump 24 (DEVPMRATE), pump 32 (AOXPMPRTE), pump 40 (FIXPMPRTE) and pump 48 (WASHPMPRTE); desired replenishment rates of exhaustion developer (DEVRATE) A-O replenishment (AOXRATE), fix replenishment (FIXRTE), and wash replenishment (WASHRATE); and density aim point values for control strips which are processed in the processor. These density aim points preferably include a low density value and a high density value. The low density set point value indicates "sensitivity" and the difference between the low density value and the high density value provides an indication of "screen range".

In addition, microcomputer 20 preferably stores speed set point values for both a process speed and a creep speed. These set point values are used in controlling film transport 18

When operation is commenced, the operator selects one of the groups of set values which corresponds to the particular photosensitive material being processed. As the leading edge of each strip of photosensitive material is fed into the processor, film width sensors 62 sense the presence of the strip, and provide a signal indicative of the width of the strip being fed into the processor. Width sensors 62 continue to provide the signal indicative of the width of the strip until the trailing edge of the strip passes sensors 62. The length of time between the leading and trailing edges of the material passing sensors 62, and the transport speed of the material (which is controlled by microcomputer 20 through film transport 18) provide an indication of the length of the strip. The width and length information for each strip is stored until the strip has been transported through the processor and reaches density scanner 64. The area of the strip and the integrated density of the strip (which is provided by the signals from density scanner 64), provide an indication of the amounts of developer and fix which have been exhausted in processing that particular strip. TABLE A illustrates how microcomputer 20 determines and controls the amount of exhaustion developer replenishment to be supplied to developer tank 10.

TABLE A

| | |
|---|---|
| A.1 | Calculate AREA = WIDTH * LENGTH |
| A.2 | Calculate DEVREPL DEVRATE * 2 * AREA * DENSITY |
| A.3 | Calculate DEVTIME = DEVREPL ÷ DEVMPRATE + DEVMINRUN |
| A.4 | If DEVTIME less than 7.5 seconds then |
| | (1) Calculate DEVMINRUN = DEVMINRUN + DEVTIME |
| | (2) Return to A.1 |
| A.5 | Output DEVTIME to counter 56 |
| A.6 | Trigger pulse sent to counter 56 and |
| | (1) Replenish flag (DEV) set |
| A.7 | Counter 56 begins decrementing and |

TABLE A-continued

| | |
|---|---|
| | (1) Developer replenishment pump 24 runs |
| A.8 | If flow switch 28 does not activate and/or Developer replenishment pump relay 26 does not energize then ERROR else |
| A.9 | If pump enable is turned off while counter 56 is running then |
| | (1) Wait 5 seconds |
| | (2) If change then resume A.8 else |
| | (3) Read value remaining in counter 56 to DEVREM |
| | (4) Clear counter 56 |
| | (5) Calculate AOXDEV = AOXDEV + (DEVTIME − DEVREM) DEVPMPRTE |
| | (6) Reset replenish flag (DEV) |
| | (7) Return to A.1 |
| A.10 | Counter 56 times out and |
| | (1) Interrupt request generated |
| A.11 | If interrupt request not acknowledged then wait, else |
| A.12 | If flow switch 28 remains activated and/or pump relay 26 remains energized then ERROR else |
| A.13 | Calculate AOXDEV = AOXDEV + DEVREPL |
| A.14 | Reset replenish (DEV) flag, clear DEVMINRUN |
| A.15 | Return to A.1 |

As shown in steps A.3 and A.4, microcomputer 20 preferably accumulates DEVTIME as DEVMINRUN until the total DEVTIME required exceeds 7.5 seconds. This provides greater accuracy, since control of pump 24 for a period less than 7.5 seconds is difficult and likely to cause inaccuracy. Similar accumulations of times are provided for the other pumps.

The anti-oxidation replenishment takes one of two forms, depending upon the particular developer chemistry used. One type of anti-oxidation replenishment is known as "blender chemistry", and the other type is known as "dual" or "two-part chemistry".

Blender chemistry is based upon a "minimum daily requirement" of anti-oxidation replenishment. This minimum daily requirement is dependent upon the amount of aerial oxidation which occurs in developer tank 10, which in turn is dependent upon the open surface area of tank 10, the operating temperature of the developer solution, and a number of other factors. With blender chemistry, some anti-oxidation replenishment is provided each time exhaustion replenishment occurs. The more exhaustion replenishment provided, the less separate anti-oxidation replenishment is required.

Two-part chemistry, on the other hand, is independent of exhaustion replenishment. Two-part chemistry replenishment is based upon a daily requirement of anti-oxidation replenishment, which is unaffected by the amount of material processed in the processor and the amount of exhaustion replenishment provided.

The replenishment control system of the present invention controls anti-oxidation replenishment from the basis of 22.5 minute intervals. During a twenty-four hour day, there are sixty-four intervals of 22.5 minutes each. AOX timer 60 provides interrupt signals to microcomputer 20 at the 22.5 minute intervals.

In the case of blender chemistry replenishment, microcomputer 20 adjusts the amount of anti-oxidation replenishment at the end of each 22.5 minute interval as a function of the amount of exhaustion replenishment which was provided during the 22.5 minute interval. If no film or paper has been run through the processor during the 22.5 minute interval, so that no exhaustion replenishment has occurred, microcomputer 20 actuates relay 34 to run pump 32 for a time period sufficient to provide 1.64th of the minimum daily requirement. If exhaustion replenishment has occurred during the 22.5 minute interval, microcomputer 20 reduces the operating time of pump 32 accordingly. If film or paper is being processed at a high enough rate during the 22.5 minute interval, no blender anti-oxidation replenishment is required, and microcomputer 20 does not activate pump 32.

In the case of two-part chemistry, microcomputer 20 actuates relay 34 at the end of each 22.5 minute interval. Relay 34 is energized for a period long enough to permit pump 32 to pump 1/64th of the daily requirement of two-part chemistry replenishment.

Table B illustrates how microcomputer 20 determines and controls anti-oxidation replenishment.

TABLE B

| | |
|---|---|
| B.1 | AOX timer 60 times out (22.5 min) (free run) |
| B.2 | If BLENDER chemistry then<br>(1) AOXREPL = (AOXRATE ÷ 64) − AOXDEV<br>(2) Reset AOXDEV<br>else AOXREPL = AOXRATE ÷ 64 (i.e. if TWO-PART chemistry) |
| B.3 | AOXTIME = AOXREPL ÷ AOXPMPRTE + AOXMINRUN |
| B.4 | If AOXTIME less than 7.5 seconds then<br>(1) Calculate AOXMINRUN = AOXMINRUN + AOXTIME<br>(2) Return to B.1 |
| B.5 | Output AOXTIME to counter 57 |
| B.6 | Trigger pulse sent to counter 57 and<br>(1) Replenish flag (AOX) set |
| B.7 | Counter 57 begins decrementing and<br>(1) Anti-ox replenishment pump 32 runs |
| B.8 | If flow switch 36 does not activate and/or Anti-ox replenishment pump relay 34 does not energize then ERROR |
| B.9 | If pump enable is turned off while counter 57 is running then<br>(1) Wait 5 seconds<br>(2) If change then resume B.8<br>else<br>(3) Read value remaining in counter 57 to AOXREM<br>(4) Clear counter 57<br>(5) Replenish flag (AOX) reset<br>(6) Return to B.1 |
| B.10 | Counter 57 times out and<br>(1) Interrupt request generated |
| B.11 | If interrupt request not acknowledged then wait; else; |
| B.12 | If flow switch 36 remains activated and/or pump relay 34 remains energized then ERROR; else; |
| B.13 | Reset replenish (AOX) flag and AOX not complete flag and clear AOXMINRUN |
| B.14 | Return to B.1 |

In the system shown in FIG. 1, the amount of fix used is inversely related to the amount of developer which is used. This differs from conventional replenishment systems, which typically provide equal amounts of developer and fix replenishment.

In addition, a carryover rate (CORTE), which guarantees a minimum amount of fix replenishment, is preferably used to account for the carryover of developer chemistry by the film as it leaves developer tank 10 and enters fix tank 12. This carryover of developer chemistry into the fix tank 12 results in a use of more fix solution than would be indicated by the information from film width sensors 54 and density scanner 56.

Table C illustrates how microcomputer 20 determines and controls fix replenishment.

TABLE C

| | |
|---|---|
| C.1 | IF FIXRTE * 2 * AREA * (1-DENSITY) < CORTE * AREA then FIXREPL = CORTE * AREA;<br>else FIXREPL = FIXRTE * 2 * AREA * (1-DENSITY) |
| C.2 | Calculate FIXTIME = FIXREPL ÷ FIXPMPRTE + FIXMINRUN |
| C.3 | If FIXTIME less than 7.5 seconds then<br>(1) Calculate FIXMINRUN = FIXMINRUN + FIXTIME<br>(2) Return to A.1 |
| C.4 | Output FIXTIME to counter 58 |
| C.5 | Trigger pulse sent to counter 58 and<br>(1) Replenish flag (FIX) set |
| C.6 | Counter 58 begins decrementing and Fix replenishment pump relay 42 does not energize then ERROR |
| C.7 | If pump enable is turned off while counter 58 is running then<br>(1) Wait 5 seconds<br>(2) If change then resume C.6<br>else<br>(3) Read value remaining in counter 58 to FIXREM<br>(4) Clear counter 58<br>(5) Replenish flag (FIX) reset<br>(6) Return to A.1 |
| C.8 | counter 58 times out and<br>(1) Interrupt request generated |
| C.9 | If interrupt request not acknowledged then wait<br>else |
| C.10 | If flow switch 44 remains activated and/or pump relay 42 remains energized then ERROR<br>else |
| C.11 | Reset replenish (FIX) flag |
| C.12 | Return to A.1 |

Wash replenishment is controlled in one of three different modes which are selected by function switches 72. The modes are designated NONSAVER, EXHAUSTION RATE, and FILM ENTRY.

Table D illustrates how microcomputer 20 determines and controls wash replenishment.

TABLE D

| | |
|---|---|
| D.1 | If NONSAVER and<br>(1) SAVER switch is ON or<br>(2) REWASH switch is ON or<br>(3) SAVER timer is running or<br>(4) RESTART timer is running then<br>(a) Turn on wash replenishment pump 48<br>else |
| D.2 | If EXHAUSTION RATE then<br>(1) Calculate WASHREPL = AREA* WASHRATE<br>else |
| D.3 | If FILM ENTRY and<br>(1) SCANNER timer is started then<br>(a) WASHREPL = FLMERYVOL<br>else |
| D.4 | Calculate WASHTIME = WASHREPL ÷ WASHPMRTE |
| D.5 | If WASHTIME less than 7.5 seconds then<br>(1) Calculate WASHMINRUN = WASHMINRUN + WASHTIME<br>(2) Return to D.1 |
| D.6 | Output WASHTIME to counter 59 |
| D.7 | Trigger pulse sent to counter 59 and<br>(1) Replenish flag (WASH) set |
| D.8 | Counter 59 begins decreasing and<br>(1) Wash replenishment PUMP 48 runs |
| D.9 | If flow switch 52 does not active and/or wash replenishment pump relay 50 does not energize then ERROR else |
| D.10 | Counter 59 times out and<br>(1) Interrupt request generated |
| D.11 | If interrupt request not acknowledged then wait else |
| D.12 | If flow switch 52 remains activated and/or pump relay 50 remains energized then ERROR<br>else |
| D.13 | Reset replenish (WASH) flag |
| D.14 | Return to A.1 |

In a "NONSAVER" mode the wash water is circulated whenever there is film in the processor, and fresh wash water is pumped by pump 48 as long as the film is in the processor. When the film exits the processor, pump 48 is halted.

In a "EXHAUSTION RATE" mode, wash replenishment is controlled on an area dependent basis, using the signals from film width sensor 62 and film transport 18 to determine the area of material passing through the processor, and in particular through wash tank 14.

In a "FILM ENTRY" mode, pump 48 is operated for a fixed time period in response to each strip of film sensed by film width sensors 62 as it enters the processor. In this embodiment, the operation of pump 48 is independent of the width and length of the film entering the processor.

The automatic replenishment control system of the present invention also provides automatic adjustment of the replenishment amounts being provided and the replenishment rates being used as a function of densities recorded on "control strips" or "test strips" which are periodically run through the processor. In one preferred embodiment of the present invention, in which the processor is a lithographic graphic arts processor, the control strips contain an area of low density (ten percent) and high density (ninety-five percent). In this embodiment, the stored aim point density values stored by microcomputer 20 are 0.04 for the 10% dot and 1.30 for the 95% dot. The operator, when requested by the processor, runs a control strip through the processor, and then measures the density of the 10% and 95% dots or areas. The numerical values of density measured by the operator by means of a densitometer are entered through keyboard 62 into microcomputer 20.

The density of the high and low density areas of the control strip indicate the "sensitivity" and "screen range" which is achieved by the processor. The sensitivity corresponds to the density of the low density (10%) dot. The screen range is the difference between the density of the 95% dot and the 10% dot. In the preferred embodiments, in which the density aim points are 0.04 and 1.30, the desired sensitivity is 0.04 and the desired screen range is 1.26.

Microcomputer 20 controls and adjusts developer exhaustion replenishment as a function of sensitivity and controls and adjusts anti-oxidation replenishment as a function of screen range.

The adjustment and control of replenishment based upon control strip density readings is generally similar for both blender chemistry replenishment and two-part chemistry replenishment, but does differ in some respects. Blender chemistry replenishment will be discussed first, followed by a discussion on two-part chemistry.

When the replenishment control of the preferred embodiment of the present invention is controlling a processor which uses blender chemistry, microcomputer 20 requests a control strip at periodic intervals, such as one each hour. In the embodiments shown in FIG. 1, microcomputer 20 makes the request for a control strip known to the operator by displaying a message on display 68. When the control strip has been run, the density measurements have been made, and the high and low density measured values have been entered through keyboard 70, microcomputer 20 first compares the measured low density value with the low density aim point. If the comparison indicates that the measured low density value (i.e. sensitivity) is within plus or minus 5% of the density aim point value, microcomputer 20 then calculates the difference between the high and low density aim point values (i.e. the desired contrast) and the difference between the measured high and low density areas (i.e. the measured contrast). If the measured screen range is within plus or minus five percent of the desired screen range, microcomputer 20 makes no adjustments to the developer exhaustion or anti-ox replenishment rates. In this situation, the processor has the necessary chemical activity to produce control strips having the desired sensitivity and screen range.

In the event that the measured sensitivity is below the desired sensitivity range, this indicates that developer tank 10 is underreplenished with developer exhaustion replenishment. Microcomputer 20 records the time of day from real time clock 74, bulk adds an additional amount of exhaustion replenishment equal to 5% of the normal developer exhaustion replenishment rate, and sets control strip timer 76 to cause microcomputer 20 to request another control strip after 15 minutes.

When the 15 minute interval has ended, the next control strip has been run, and the measured density values have been entered, microcomputer 20 again compares the measured sensitivity with the desired sensitivity. If the measured sensitivity is still below the desired sensitivity range, microcomputer 20 increases the exhaustion replenishment rate (DEVRATE) by 5%, records time, bulk adds 5% of the exhaustion replenishment rate, and sets timer 76 to request a new control strip in 15 minutes. This process is repeated with control strips run at 15 minute intervals until the measured sensitivity is within the desired sensitivity range.

If the density of the 10% dot area exceeds the density aim point value by more than 5%, so that it is above the desired sensitivity range, this indicates that the developer fluids are overreplenished. When microcomputer 20 identifies this situation, it records the time of day, turns off or inhibits any further exhaustion replenishment for a period of 15 minutes, and then sets timer 76 to request a new control strip after the 15 minute interval. If the measured sensitivity of the new control strip is still above the desired sensitivity range, microcomputer 20 decreases the exhaustion replenishment rate (DEVRATE) by 5%, records the time, again turns off the exhaustion replenishment for another 15 minute interval, and sets timer 76 to ask for a new control strip at the end of the 15 minute interval. This process continues until the measured sensitivity is once again within the desired sensitivity range.

Microcomputer 20 does not readjust the anti-oxidation replenishment until it has determined that the sensitivity is within the desired sensitivity range. Once this condition is met, microcomputer 20 then compares the measured screen range of the control strip with the desired screen range. If the measured screen range is within plus or minus 5% of the desired screen range, anti-oxidation replenishment is within the desired range, and microcomputer 20 makes no further adjustment. The microcomputer 20 then goes back to a one hour time interval for requesting control strips.

If the measured screen range is more than 5% below the desired screen range, this indicates that further A-O replenishment is required. In this case, microcomputer 20 records the time, bulk adds 5% of the normal A-O replenishment (i.e. AOXRATE÷64), and asks for a new control strip after a 15 minute interval. If the measured screen range is still more than 5% below the desired screen range, microcomputer 20 increases the minimum daily requirement replenishment rate (AOX- RATE) by 5%, and then checks measured sensitivity, (and assuming the sensitivity is still within range) records time, bulk adds five percent of the normal A-O replenishment (AOXRATE÷64), and sets timer 76 to ask for a new control strip after a 15 minute interval. This process continues until the measured contrast is within the desired contrast range.

If the measured screen range is greater than 5% of the desired screen range, this indicates an overreplenishment of the A-O replenishment. Microcomputer 20 then turns off or inhibits A-O replenishment for a 15 minute interval, records the time, and sets timer 76 to request a new control strip after 15 minutes. If the measured screen range of the next control strip is still more than 5% greater than the desired screen range, microcomputer 20 decreases the minimum daily requirement replenishment rate (AOXRATE) by 5%, checks the measured sensitivity of the new control strip against the desired sensitivity, inhibits A-O replenishment during the following 15 minute interval, records time, and sets timer 76 to request a new control strip after 15 minutes. This process continues until the measured screen range is within the range of the desired screen range.

In other words, whenever the sensitivity or screen range goes outside of a desired range of value, the processor is in a possible error condition. Microcomputer 20 initially makes small bulk adjustments by bulk adding replenishment (either exhaustion or anti-oxidation), or inhibiting replenishment for a 15 minute interval. At the end of a 15 minute interval, another control strip is requested, so that the microcomputer 20 can monitor the effects of its corrective action on a shorter term basis than usual. If the sensitivity or screen range remain out of desired ranges, microcomputer 20 begins adjusting the replenishment rates until the sensitivity and screen range are brought back under control.

In the case of two-part A-O chemistry, the deviations of the developer chemistry are somewhat easier to control, since the anti-oxidation replenishment is completely independent of exhaustion replenishment. As a result, adjustments to replenishment based upon control strip readings need not be made as rapidly as in the case of blender chemistry. In the preferred embodiment of the present invention, microcomputer 20 requests control strips every hour, or whenever the total of 5 square meters of photosensitive material has been processed using two-part chemistry. Corrections are made on a similar manner to those used with blender chemistry except that bulk additions of developer or A-O replenishment are made on the basis of 10% rather than 5% of normal replenishment rate (i.e. either DEVRATE or AOXRATE÷64). Similarly, changes to the replenishment rates (DEVRATE or AOXRATE) are 10% rather than 5%. Similar to blender chemistry replenishment, however, the measured sensitivity and screen range are required to be maintained within plus or minus 5% of their desired values. A final difference between two-part chemistry control and blender chemistry control is that in two-part chemistry changes are made to DEVRATE or AOXRATE only after deviation continues after three successive two-hour intervals. In other words, microcomputer 20 waits until the measured sensitivity and screen range of the control strips have been out of range for a long time period before it makes a basic correction to the replenishment rates. Microcomputer 20 will bulk add or inhibit replenishment prior to that time, but will only make a change to the basic replenishment rates after three successive two-hour intervals in which the measured values remain out of the desired ranges.

Table E illustrates how microcomputer 20 adjusts replenishment by use of measured densities from control strips.

TABLE E

| | |
|---|---|
| E.1 | Blender chemistry and measured sensitivity below desired sensitivity range then<br>(1) Record time<br>(2) Bulk add exhaustion replenishment (5% of DEVRATE)<br>(3) Ask for new control strip after 15 minutes |
| E.2 | If measured density of new control strip still below desired sensitivity range increase replenishment rate (DEVRATE) 5% and check again. Go to E.1 |
| E.3 | If blender and measured sensitivity above desired sensitivity range then<br>(1) Record time<br>(2) Turn off exhaustion replenishment for 15 minutes<br>(3) Ask for new control strip after 15 minutes |
| E.4 | If measured density of new control strip still above desired sensitivity range decrease replenishment rate (DEVRATE) 5% and check again. Go to E.1 |
| E.5 | If blender and measured screen range below desired range, then<br>(1) Record time<br>(2) Bulk add A-O replenishment (5% of AOXRATE ÷ 64)<br>(3) Ask for new control strip after 15 minutes |
| E.6 | If measured screen range of new control strip still below desired range, increase MDR replenishment rate (AOXRATE) 5% and check again. Go to E.1 |
| E.7 | If blender and measured screen range above desired range, then<br>(1) Record time<br>(2) Turn off A-O replenishment for 15 minutes<br>(3) Ask for new control strip after 15 minutes |
| E.8 | If measured screen range of new control strip still above desired range decrease MDR rate (AOXRATE) 5%. Go to E.1 |
| E.9 | If two-part chemistry, similar to E.1 through E.8, except<br>(1) New control strip every hour or $5m^2$ of material<br>(2) Changes to DEVRATE and AOXRATE are 10%<br>(3) Changes to DEVRATE and AOXRATE are only after deviation from desired range continues after 3 successive 2 hour intervals. |

Figure 2:
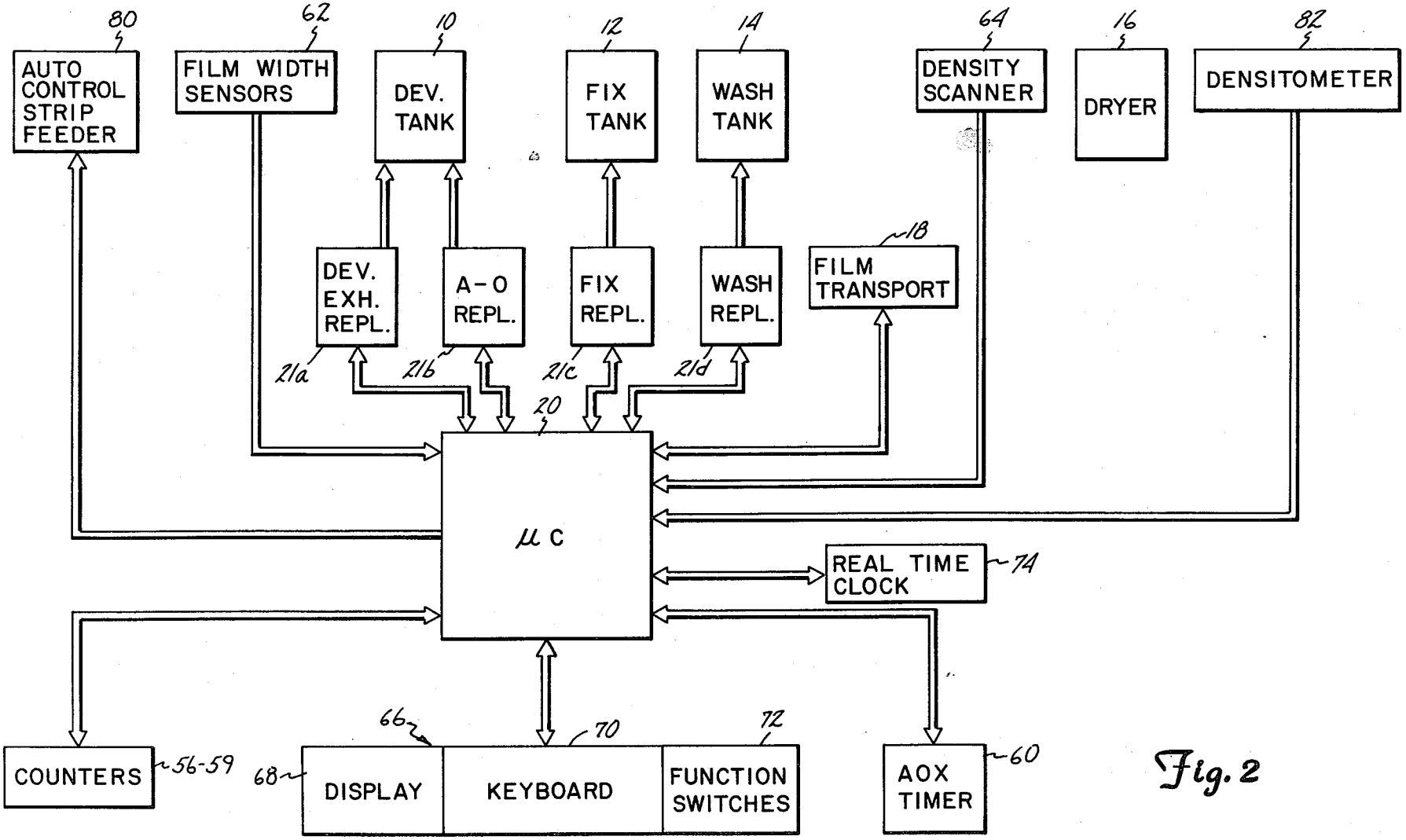
FIG. 2 is a block diagram illustrating another preferred embodiment of the automatic replenishment control system of the present invention.

Although the specific embodiments shown in FIG. 1, the feeding of the control strip and the entering of the measured density values are performed on a manual basis, the present invention is particularly well adapted for use in a totally automatic system. FIG. 2 shows a block diagram of a replenishment control system of this type. In the embodiments shown in FIG. 2, elements shown which are similar to those illustrated in FIG. 1 are designated with similar reference numerals.

In the system of FIG. 2, microcomputer 20 controls automatic control strip feeder 80, which feeds a control strip into the processor in response to control signals from microcomputer 20. When the control strip has been processed, densitometer 82 measures the densities of at least two areas of the control strip and provides signals to microcomputer 20 which are indicative of the measured densities. From the measured densities, and the density aim point values, microcomputer 20 makes adjustments to the replenishment in the manner similar to that described with reference to FIG. 1. In the embodiment shown in FIG. 2, however, the feeding of control strip at intervals selected by microcomputer 20 is performed without requiring operator intervention.

In conclusion, the automatic replenishment control system of the present invention provides accurate control of replenishment to a photographic processor. This replenishment is based not only upon stored replenishment rates, measured area of material being processed, and measured density of the processed material, but also upon stored density aim point values and control strip readings. When a possible error condition is indicated by the measured densities of the control strips, the automatic replenishment system first attempts corrective action (i.e. bulk adding or inhibiting replenishment) without changing the replenishment rates. If this is not completely effective, it makes corrections to the replenishment rates in order to bring the measured densities into the desired ranges.

The system of the present invention, by initially making small bulk adjustments (i.e. bulk add or inhibit replenishment for short period), and by requesting another control strip after a predetermined time interval, is able to determine whether the deviation of the measured sensitivity or screen range from the desired ranges represents a long term trend or only a short duration deviation. For example, if a single sheet having very dense images is processed, a temporary deviation in sensitivity and screen range of the control strip may occur. If the sheets processed subsequently are like the normal density, the control system of the present invention will make the necessary bulk adjustments without making long term changes to the replenishment rates. On the other hand, if subsequent sheets continue to have the high density, the resulting changes in developer chemistry will be recognized by the control system as a longer term trend, and appropriate adjustments to the replenishment rates will be made.

Although the present invention has been described with reference to preferred embodiments, workers skilled in the art will recognize that changes may be made in form and detail without departing from the spirit and scope of the invention.

What is claimed is:

1. In a processor of photosensitive material having replenishment means for replenishment of processor chemistry, an automatic replenishment control system comprising:

means for storing a replenishment rate;

means for controlling replenishment as a function of the replenishment rate;

means for storing values indicative of desired parameter values of control strips of photosensitive material processed in the processor;

means for providing signals indicative of measured parameter values of the control strips processed in the processor;

means for automatically making a short term replenishment correction if the measured parameter value deviates from the desired parameter value; and means for automatically adjusting the stored replenishment rate if a deviation between the measured and desired parameter values persists in a subsequent control strip processed by the processor despite a previous short term replenishment correction.

2. The invention of claim 1 wherein the short term correction is a bulk addition of a selected amount of replenishment if the deviation of the measured parameter value from the desired parameter value is in a first direction, and is an inhibition of replenishment for a selected time interval if the deviation is in a second opposite direction.

3. The invention of claim 2 wherein the means for automatically adjusting the stored replenishment rate increases the stored replenishment rate if the deviation is in the first direction, and decreases the stored replenishment rate if the deviation is in the second direction.

4. The invention of claim 1 and further comprising:

means for automatically requesting a new control strip after a predetermined time interval.

5. The invention of claim 4 and further comprising:

means for automatically feeding a new control strip into the processor in response to a request for a new control strip.

6. The invention of claim 1 wherein the parameter value is sensitivity, and wherein the stored replenishment rate is for developer exhaustion replenishment.

7. The invention of claim 1 wherein the parameter is screen range and wherein the replenishment rate is for anti-oxidation replenishment.

8. The invention of claim 1 wherein the parameter values of the control strips are densities of at least two areas of the control strips.

9. The invention of claim 8 wherein the means for providing signals indicative of measured parameter values comprises densitometer means for measuring density of the areas of the control strips.

10. A method of adjusting replenishment rates for replenishment of processor chemistry in a processor of photosensitive material, the method comprising:

(a) processing a control strip in the processor;

(b) measuring a parameter of the processed control strip which is affected by processor chemistry;

(c) comparing the measured parameter with a desired value;

(d) automatically adding a selected amount of additional replenishment if the measured parameter deviates from the desired value in a first manner;

(e) automatically inhibiting replenishment for a selected time interval if the measured parameter deviates from the desired value in a second manner;

(f) processing a new control strip after a predetermined time interval;

(g) measuring a parameter of the new processed control strip which is affected by processor chemistry;

(h) comparing the measured parameter with the desired value;

(i) automatically increasing the replenishment rate if the measured parameter of the new processed control strip continues to deviate from the desired value in the first manner; and (j) automatically reducing the replenishment rate if the measured parameter continues to deviate from the desired value in the second manner.

11. The method of claim 10 wherein the measured parameter is sensitivity and the replenishment rate is for exhaustion replenishment.

12. The method of claim 10 wherein the measured parameter is screen range and the replenishment rate is for anti-oxidation replenishment.

13. The method of claim 10 wherein steps (f) through (j) are repeated until the measured parameter no longer continues to deviate from the desired value.

14. The method of claim 10 and further comprising:

(k) automatically adding a selected amount of additional replenishment if the measured parameter of the new processed control strip continues to deviate from the desired value in the first manner; and (l) automatically inhibiting replenishment for a selected time interval if the measured parameter of the new processed control strip continues to deviate from the desired value in the second manner.

15. The method of claim 14 wherein steps (f) through (l) are repeated until the measured parameter no longer continues to deviate from the desired value.

16. In a processor of photosensitive material having developer exhaustion replenishment means for providing developer exhaustion replenishment, and anti-oxidation replenishment for providing anti-oxidation replenishment, an automatic replenishment control system comprising:

means for storing a developer exhaustion replenishment rate;

means for controlling developer exhaustion replenishment as a function of the developer exhaustion replenishment rate;

means for storing an anti-oxidation replenishment rate;

means for controlling anti-oxidation replenishment as a function of the antioxidation replenishment rate;

means for storing first and second density aim point values;

means for providing signals indicative of first and second measured density values of control strips processed in the processor;

means for automatically adjusting developer exhaustion replenishment as a function of the first density aim point value and the signal indicative of the first measured density value; and means for automatically adjusting anti-oxidation replenishment as a function of the first and second density aim point values and the signals indicative of the first and second measured density values.

17. The invention of claim 16 wherein the means for automatically adjusting developer exhaustion replenishment comprises:

means for automatically making a short term developer exhaustion replenishment correction if the first measured density value deviates from the first density aim point value; and means for automatically adjusting the stored developer exhaustion replenishment rate if a deviation of the first measured density value from the first density aim point value in a subsequent control strip processed by the processor continues despite a previous short term developer exhaustion replenishment correction.

18. The invention of claim 16 wherein the means for automatically adjusting anti-oxidation replenishment comprises:

means for automatically making a short term anti-oxidation replenishment correction if a difference between the first and second measured density values deviates from a difference between the first and second density aim point values; and means for automatically adjusting the stored anti-oxidation replenishment ratio if the deviation of the difference between the first and second measured density values from the difference between the first and second density aim point values in a subsequent control strip processed by the processor continues despite a previous short term anti-oxidation replenishment correction.

19. In a processor of photosensitive material, an automatic replenishment control system comprising:

means for storing a developer exhaustion replenishment rate;

means for controlling developer exhaustion replenishment as a function of the developer exhaustion replenishment rate;

means for storing a first density aim point value;

means for providing signals indicative of first measured density values of control strips processed in the processor; and means for automatically adjusting developer exhaustion replenishment as a function of the first density aim point value and the signal indicative of the first measured density value.

20. The invention of claim 19 wherein the means for automatically adjusting developer exhaustion replenishment comprises:

means for automatically making a short term developer exhaustion replenishment correction if the first measured density value deviates from the first density aim point value; and means for automatically adjusting the stored developer exhaustion replenishment rate if a deviation of the first measured density value from the first density aim point value in a subsequent control strip processed by the processor continues despite a previous short term developer exhaustion replenishment correction.

21. The invention of claims 19 or 20 and further comprising:

means for automatically requesting, at selected time intervals, that a control strip be fed into the processor for processing.

22. The invention of claim 21 and further comprising:

means for automatically feeding a control strip into the processor in response to a request from the means for requesting.

23. In a processor of photosensitive material, an automatic replenishment control system comprising:

means for storing an anti-oxidation replenishment rate;

means for controlling anti-oxidation replenishment as a function of the antioxidation replenishment rate;

means for storing first and second density aim point values;

means for providing signals indicative of first and second measured density values of control strips processed in the processor; and p1 means for automatically adjusting anti-oxidation replenishment as a function of the first and second density aim point values and the signals indicative of the first and second measured density values.

24. The invention of claim 23 wherein the means for automatically adjusting anti-oxidation replenishment comprises:

means for automatically making a short term anti-oxidation replenishment correction if a difference between the first and second measured density values deviates from a difference between the first and second density aim point values; and means for automatically adjusting the stored anti-oxidation replenishment rate if the deviation of the difference between the first and second measured density values from the difference between the first and second density aim point values in a subsequent control strip processed by the processor continues despite a previous short term anti-oxidation replenishment correction.

25. The invention of claims 23 or 24 and further comprising:

means for automatically requesting, at selected time intervals, that a control strip be fed into the processor for processing.

26. The invention of claim 25 and further comprising:

means for automatically feeding a control strip into the processor in response to a request from the means for requesting.

* * * * *

UNITED STATES PATENT OFFICE

CERTIFICATE OF CORRECTION

Patent No. 4,293,211 Dated October 6, 1981

Inventor(s) Kenneth M. Kaufmann

It is certified that error appears in the above-identified patent and that said Letters Patent are hereby corrected as shown below:

Column 16, line 50, delete "pl" and insert therefor an indented paragraph, beginning with the word "means".

Signed and Sealed this

*Twenty-second* Day of *December 1981*

|SEAL|

*Attest:*

GERALD J. MOSSINGHOFF

*Attesting Officer*

*Commissioner of Patents and Trademarks*